US006530828B1

(12) United States Patent
Kolthoff

(10) Patent No.: US 6,530,828 B1
(45) Date of Patent: Mar. 11, 2003

(54) SUPPORTING PLATE FOR ROTATING TOOLS FOR THE FINE MACHINING OF SURFACES

(75) Inventor: Dieter Kolthoff, Fluëelen (CH)

(73) Assignee: Kolthoff & Co., Flueelen (CH)

( * ) Notice: Subject to any disclaimer, the term of this patent is extended or adjusted under 35 U.S.C. 154(b) by 0 days.

(21) Appl. No.: 09/546,700

(22) Filed: Apr. 10, 2000

(30) Foreign Application Priority Data

Apr. 9, 1999 (DE) ..... 299 06 328 U

(51) Int. Cl.[7] ..... B24D 17/00
(52) U.S. Cl. ..... 451/490; 451/509; 451/510
(58) Field of Search ..... 451/490, 509, 451/514, 515, 516, 517, 510

(56) References Cited

U.S. PATENT DOCUMENTS

| | | | | | |
|---|---|---|---|---|---|
| 2,480,886 | A | * | 9/1949 | Stever | 451/509 |
| 2,958,166 | A | * | 11/1960 | Foland | 451/490 |
| 3,395,417 | A | * | 8/1968 | Matouka | 451/490 |
| 3,491,494 | A | * | 1/1970 | MacKay, Jr. | 451/509 |
| 3,574,978 | A | * | 4/1971 | Block | 451/509 |
| 3,653,857 | A | * | 4/1972 | Field | 451/490 |
| 3,683,567 | A | * | 8/1972 | Ali | 451/490 |
| 3,808,753 | A | * | 5/1974 | Maran | 451/490 |
| 3,864,884 | A | * | 2/1975 | Weissman | 451/490 |
| 4,138,804 | A | * | 2/1979 | Thielen | 451/490 |
| 4,245,438 | A | * | 1/1981 | Van Buren, Jr. | 451/509 |
| 4,683,683 | A | * | 8/1987 | Block | 451/509 |
| 4,920,702 | A | * | 5/1990 | Kloss et al. | 451/490 |
| 5,309,682 | A | * | 5/1994 | Gutknecht et al. | 451/490 |
| 5,400,461 | A | * | 3/1995 | Malish et al. | 451/516 |
| 5,619,770 | A | * | 4/1997 | Bell | 451/514 |
| 6,059,644 | A | * | 5/2000 | Manor et al. | 451/490 |
| 6,059,910 | A | * | 8/2000 | Luedeke | 451/490 |
| 6,227,959 | B1 | * | 5/2001 | Beaudry | 451/490 |

* cited by examiner

*Primary Examiner*—Eileen P. Morgan
*Assistant Examiner*—Hadi Shakeri
(74) *Attorney, Agent, or Firm*—Jordan and Hamburg LLP

(57) ABSTRACT

Supporting plate for rotating tools for fine machining of surfaces, such as grinding or polishing with a front working surface or an adhering surface for detachably mounting a grinding, polishing, or similar working medium disk, having a rear driving connection and configured to provide for simple manipulation, advantageously priced adaptability and a rapid exchangeability. The supporting plate has an elastically deformable, exchangeability plate and an accommodating carrier. The exchangeable plate provides the working or adhering surface and has an interior space engaged from the rear by a coupling structure of the accommodating carrier with a bayonet or similar quick-change connection at an edge.

27 Claims, 6 Drawing Sheets

SUPPORTING PLATE FOR ROTATING TOOLS FOR THE FINE MACHINING OF SURFACES

BACKGROUND OF THE INVENTION

Supporting plates for rotating tools, such as tool attachments for hand drilling machines in a one-piece form from an elastomeric material have long been known. A front adhering surface, which is, for example, smooth so that a grinding or polishing disk can be glued to it, is provided with an adhesive back or completely or partially with a hook (Velcro) surface for simply attaching grinding or polishing disks with a suitable loop covering. When working with such a supporting plate, the grinding or polishing disk normally is not pressed with its complete surface against the workpiece. Instead, it is applied at an angle, the contacting area varying with the contacting pressure and the resilience of the material of the supporting plate. The grinding and polishing disks are used up rapidly and can therefore be exchanged easily. However, the supporting plates also experience wear and damage during inattentive work when the disks are exchanged too late, in the case of difficult surface configurations as well as when the resilience of the supporting plate is not adapted well.

In addition, there are stiff rotating tools for the fine machining of surfaces in the form of laminated grinding disks, for which strips of layers of working media, superimposed in laminated fashion, are applied on an exchangeable plate with formation of a raised, truncated cone shape, which usually is in contact with only a portion of the periphery with the surface that is to be machined. Such an exchangeable plate with a bayonet fitting or similar connection to an accommodating carrier is to be exchanged with the bearing, possibly damaged exchangeable plate body when the working media are used up.

However, such a laminated grinding disk is expensive. Moreover, the stiff nature of the laminated grinding disk requires relatively sensitive and careful work, so that punctiform unevennesses do not arise during the machining due to tilting.

SUMMARY OF THE INVENTION

It is an object of the invention to provide a supporting plate, the handling of which is not critical and which can be adapted with little cost to different work requirements and, when damaged in the region of the adhering surface, can be renewed inexpensively.

This objective is accomplished with a supporting plate of claim 1. Such a supporting plate permits conventional, advantageously priced grinding, polishing or similar disks to be used on an adhering surface, which lies on a plastically deformable plate and with that lies flat spread against the workpiece, which is to be processed, without the danger of the dangerous tilting. As exchangeable plate, this plate can be exchanged not only when there is wear or damage, but also when a softer or firmer contacting pressure is required. Likewise, such an exchangeable plate can be exchanged when, instead of a hook facing, a smooth, adhering surface for other working media disks is required.

A quick-change connection in the form of a bayonet connection, especially if the direction of rotation of the tool is fixed, makes possible a simple loosening in the opposite direction. It is self evident that the quick-change connection for this purpose can also be brought about readily in a different known manner, perhaps in the form of "clip" or locking connections.

It is particularly advantageous if the accommodating carrier, which lies behind on the drive side and is normally not exchanged, engages the interior of the exchangeable plate with a coupling continuation, so that the latter embraces towards the outside the plate material that is to be specified for the supporting forces but, on the inside, is reduced from the point of view of material and therefore also of material costs. Since this region does not have to yield, as does the edge, the interior region of the exchangeable plate can be supported rigidly on the accommodating carrier. In this region, the exchangeable plate, as a whole, can be interrupted to an annular shape or constructed only to a closed adhering surface at the front side as a thin covering surface.

Advantageously, the accommodating carrier can still have a flange around the inner quick-change connection, with which it supports the exchangeable plate over an annular region, so that the exchangeable plate can be constructed correspondingly thinner, material thus being saved.

In many cases, however, the exchangeable plate can also advantageously be constructed itself as a tool if the material-saving and flexible configuration of the exchangeable plate offers a brush-like refinement.

Two examples of the invention are shown in the drawings and described in greater detail in the following.

DESCRIPTION OF THE PREFERRED EMBODIMENTS

Figure 3:
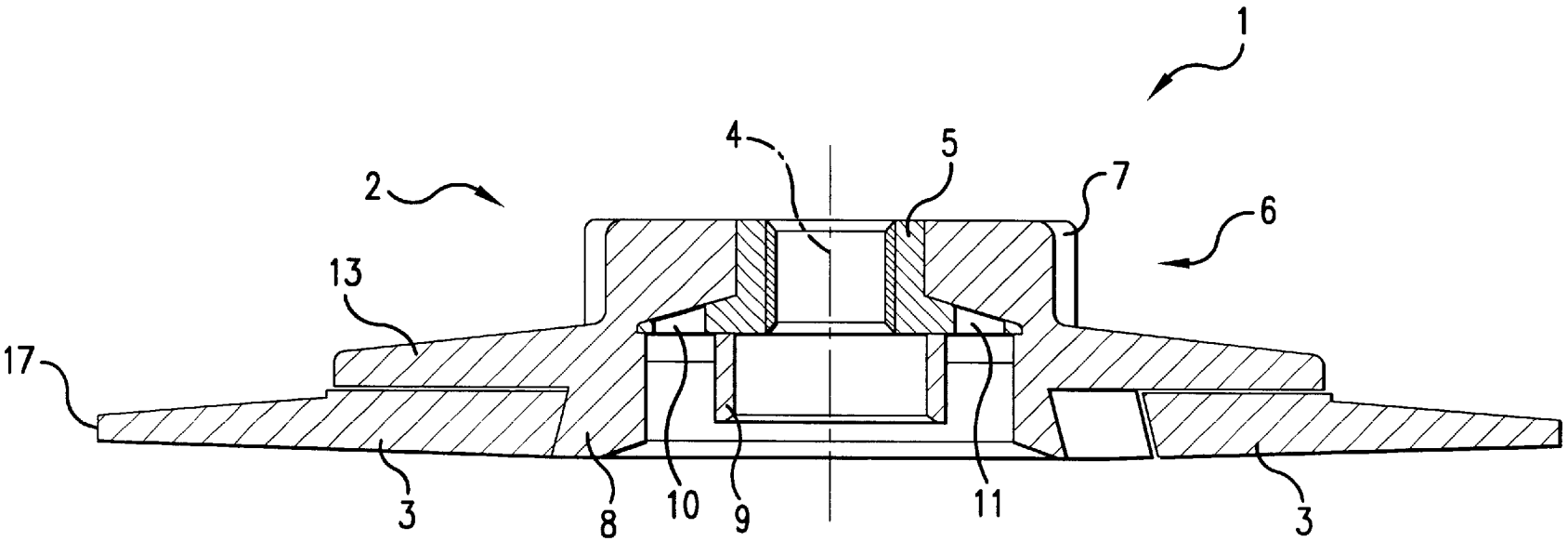
FIG. 3 shows a section along the line III—III in FIG. 1 through the accommodating carrier, supplemented by an exchangeable plate.

A supporting plate, labeled 1 as a whole in the sectional representation of FIG. 3, comprises an accommodating carrier 2 and an annular exchangeable plate 3. The accommodating carrier 2 consists of an injection molded synthetic resin part, which is essentially symmetrical to the center axis 4, with an embedded metal nut 5, which is to be screwed onto a suitable threaded stub of a driving motor and, accordingly forms a driving connection. About this driving connection 5, the accommodating carrier 2 has handle periphery 6 with six ribs 7, so that it can be engaged better manually or by a tool.

On the front side, axially opposite the driving connection 5, the accommodating carrier 2 is equipped with a coupling continuation 8 to a quick-change connection with the exchangeable plate 3. Radially, on the inside, the coupling continuation 8 is interrupted to the nut 5, so that there is a free passage here for lock nuts, securing elements and the like. Two blind holes 10, 11 for providing access to a tightening key from the front side, are disposed radially opposite one another about a collar 9 around the inner region of the nut 5, which protrudes to the front side of the supporting plate from the nut as a protective ring.

Figure 1:
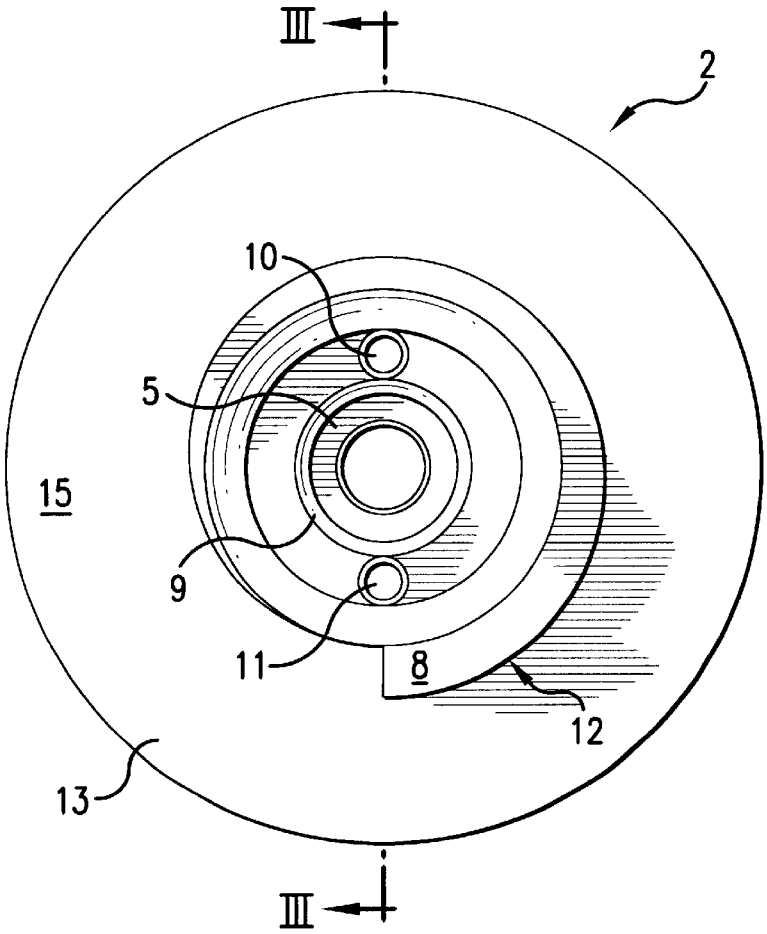
FIG. 1 shows a front view of the accommodating carrier for a supporting plate.
Figure 2:
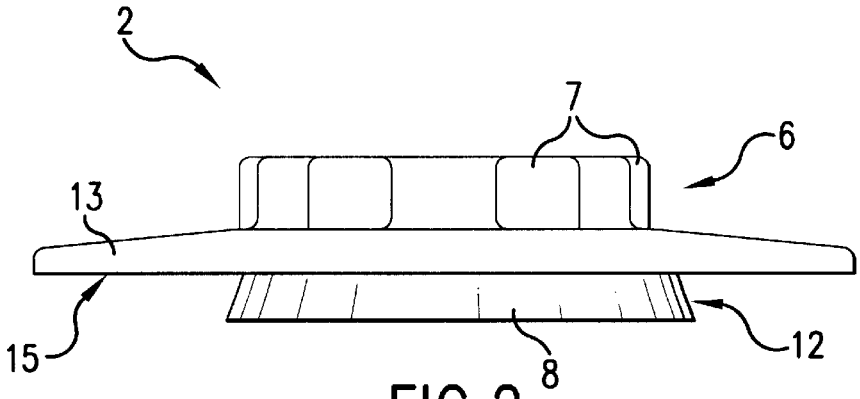
FIG. 2 shows a side view of the accommodating carrier of FIG. 1.

As can be recognized from the view of the accommodating carrier 2 from FIGS. 1 and 2, a spirally shaped, slightly undercut edge contour of the coupling continuation 8 provides a worm seat which, in conjunction with a suitable counter-contour, can be engaged very easily rotatively and, during a given direction of rotation during the work, is tightened automatically and, in the opposite direction, can also be loosened easily. In this region, the accommodating carrier 2 enters into a stiff, positive connection with the exchangeable plate 3. In this connection, the smooth back-cut shape with the inclined flank can be handled more easily and more quickly than a stepped edge contour.

Moreover, the accommodating carrier 2 furthermore supports the exchangeable plate 3 with a flange 13 over a portion of the (larger) radius of the exchangeable plate 3, so that the latter, with a specified deformability and resilience, can be configured to be relatively thin and, with that, advantageously priced.

At the same time, the exchangeable plate 3, with a rear annular surface 14, lies against a suitable annular surface 15 of the flange 13. Both annular surfaces are constructed flat in the present case, even though this is not absolutely essential, as long as there is a suitable fit. In an annular region 16 extending beyond the flange 13 of the accommodating carrier 2, the thickness of the exchangeable plate 3 decreases in the direction of an external edge 17. In this connection, it is particularly interesting that the exchangeable plate 3 is not flat in an edge region of the front side 18 and, instead, is constructed raised or spherical and, in this respect, also already partly takes into account a slightly inclined touching down of the supporting plate.

On the inside, the exchangeable plate 3 and, with that, also its front side 18, have a recess, the spirally shaped edge 19 of which interacts with the coupling continuation 8 of the accommodating carrier 2. The interruption of the front side 18 is harmless, insofar as only the peripheral regions of the exchangeable plate are required for the operating engagement. On the other hand, the central region could also be closed off at the front side 18 by an optionally thin-walled inner region. However, in that case, the quick-change connection to the accommodating carrier 2 would be concealed and consequently more difficult to control. On the front side 18, a central working disk, such as a grinding disk, can be attached with an adhesive back and pulled off when used up.

The exchangeable plate 3 can be varied with respect to the thickness of the plate, the variation in the thickness of the plate towards the edge, the material selected, the external diameter and/or the truncated cone or convex shape of the front side 18 in order to offer appropriate plate properties to the different working media and the different deformations during the work. For this purpose, different exchangeable plates should be made available. This would not be expensive in the case of an inventive, material-saving configuration and a simple possibility for exchanging plates. Likewise, exchangeable plates could be available, the surface of which is not only smooth, as in the case of the present example and, with that, suitable as an adhesion surface for self-adhesive working media disks, but also provided with a Velcro facing or with clamping elements. Moreover, in exchange for the exchangeable plates described above, exchangeable plates can also be provided, which are themselves constructed as working media. For example, this exchangeable plate can be equipped with a brush or rough facing for finishing work and used after a grinding process or provided with abrasive-filled bristles for grinding.

Figure 4:
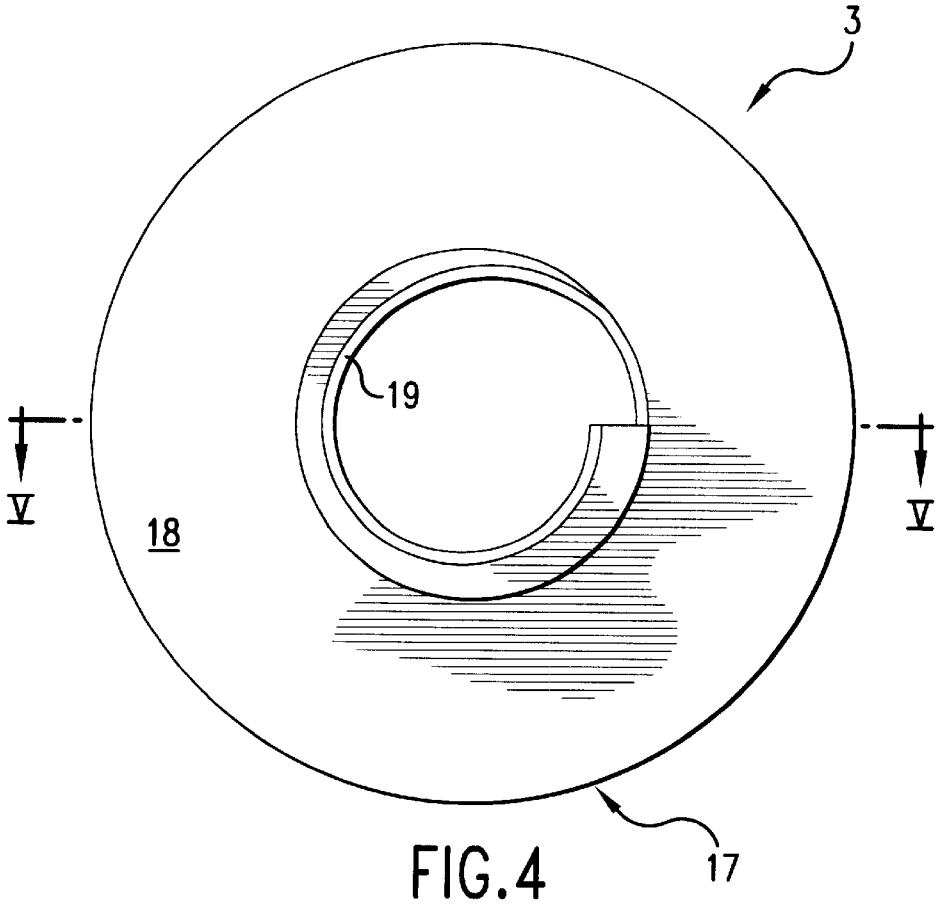
FIG. 4 shows a front view of the exchangeable plate of FIG. 3.
Figure 5:
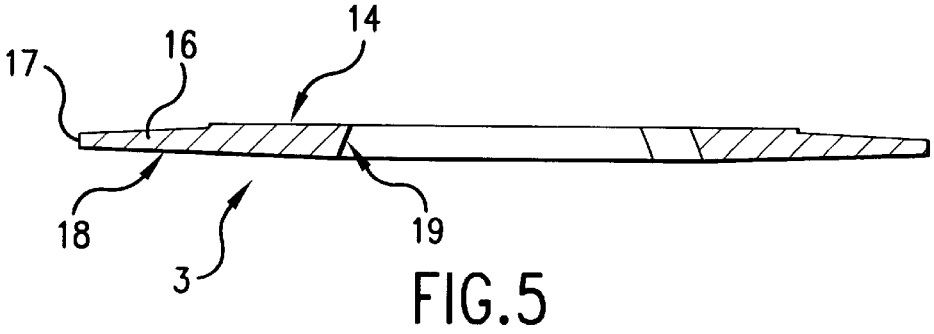
FIG. 5 shows a section along the line V—V through the exchangeable plate of FIG. 4.
Figure 6:
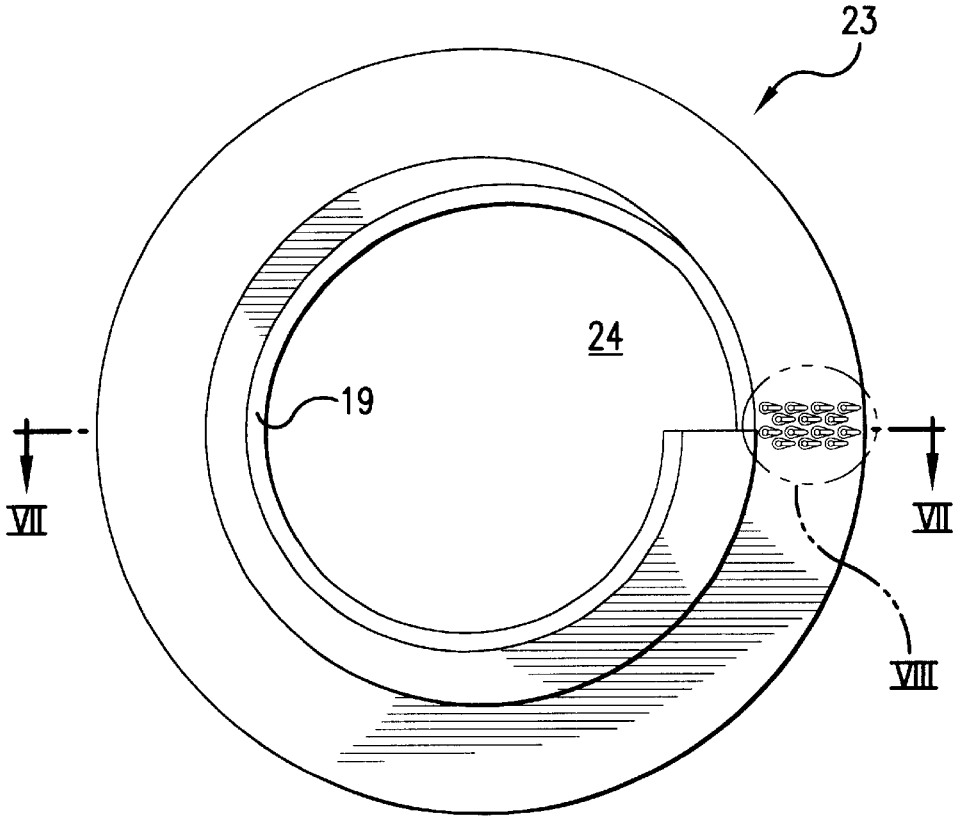
FIG. 6 shows a view of a second exchangeable plate, constructed as a polishing brush, from below.
Figure 7:
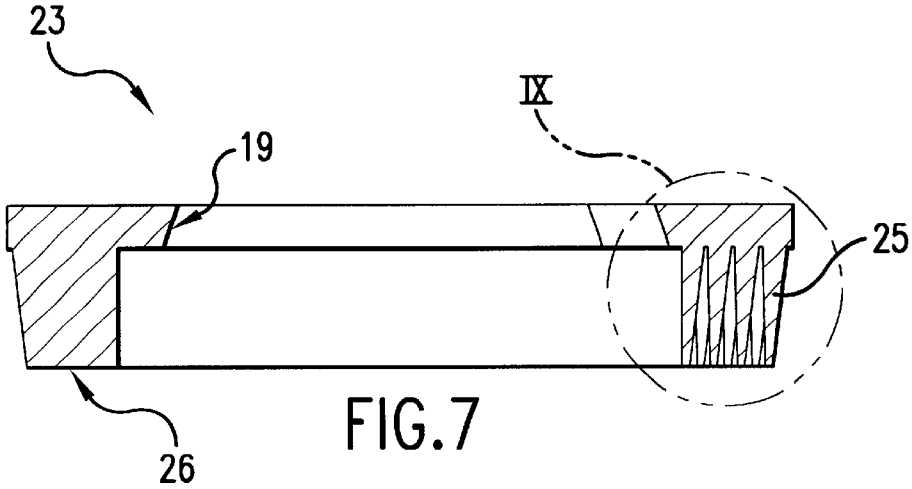
FIG. 7 shows a section along the line VII—VII in FIG. 6.

In FIGS. 6 and 7, a further exchangeable plate 23 is shown, which has a smaller external diameter than the exchangeable plate of FIGS. 4 and 5, but the same spirally shaped edge 19 at a free inner opening 24 for placement upon a supporting carrier 2 of FIGS. 1 and 2. The exchangeable plate is formed in one piece from an elastomeric material and consequently is flexible as a whole. When placed on the accommodating carrier 2, it finds a firm support on the latter.

Figure 8:
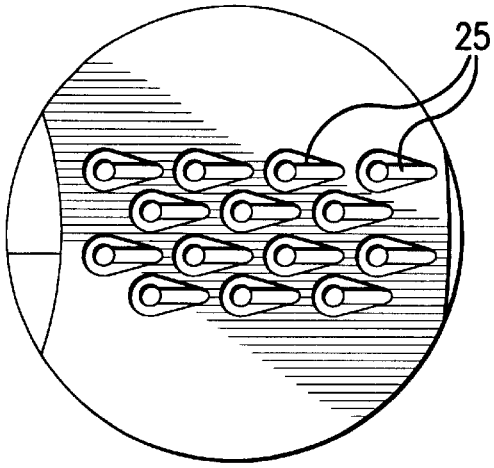
FIG. 8 shows a detail VIII from FIG. 6 on an enlarged scale.
Figure 9:
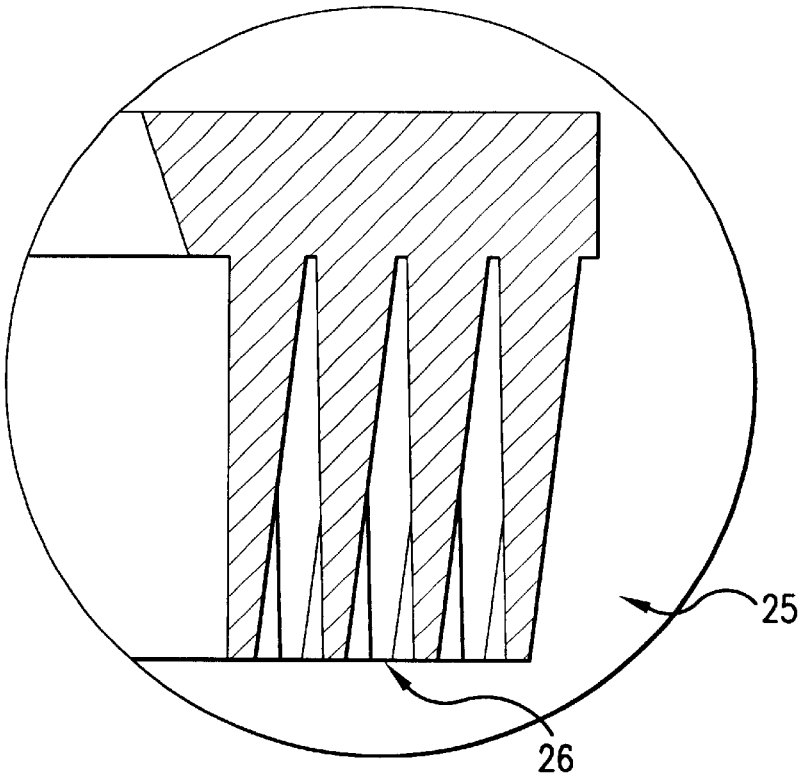
FIG. 9 shows the enlarged detail IX in FIG. 7.
Figure 10:
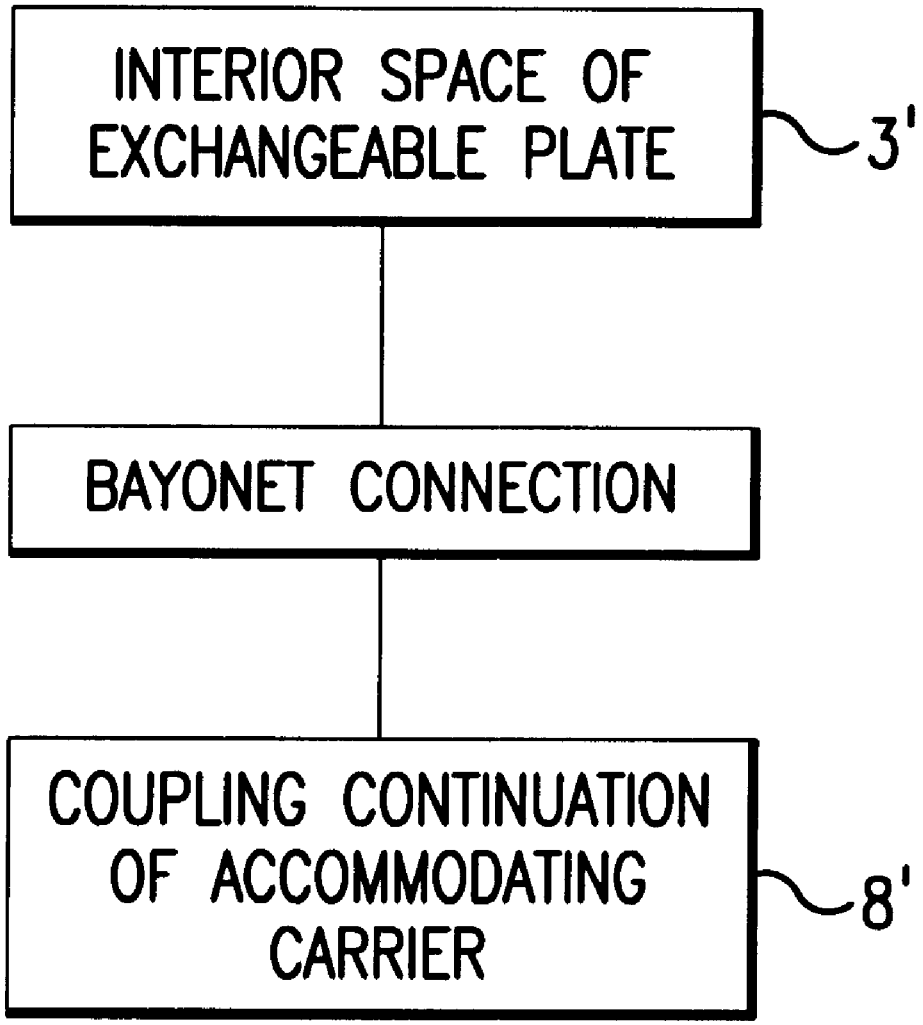
FIG. 10 showing a schematic of a supporting plate in accordance with an embodiment of the invention wherein the coupling continuation of the accommodating carrier is coupled to the interior space of the exchangeable plate by means of a bayonet connection.

The relatively soft elastomeric material enables bristle-like continuations 25 to be formed, similar to those, which can be seen in a three-fold enlargement in FIGS. 8 and 9. These bristle-like continuations 25 in each case have a conical pin shape, which runs out into a flat boundary surface, this flat boundary surface defining a working surface 26. Such bristle-like continuations 25 are elastically yielding as required for grinding, polishing or brushing work. The flexibility in or counter to the direction of rotation of the exchangeable plate 23 is supported by a cross-sectional shape of the bristle-like continuations 25, which can be seen in FIG. 8 and has a larger dimension in the radial direction than in the tangential direction. Moreover, the bristle-like continuations 25 are set radially inwards slightly so that, during a rotational mode of operation, they are deflected more in the upright direction than in the outward direction.

In the present case, the bristle-like continuations 25 are filled with an abrasive, namely powdery corundum and, with that, can be used instead of grinding disks. It is self-evident that other polishing materials can be embedded in the elastomeric material of the exchangeable plate 23 or also mounted on such continuations as the pin-like continuations 25 at the surface. In this connection, the advantage of an exchangeable plate, which can be manufactured very simply and easily in a material-saving manner, as well as the very rapid exchange, are retained.

What I claim is:

1. A supporting plate for rotating tools, comprising:

an accommodating carrier including a flat forward surface and a coupling continuation arranged on and projecting from said forward surface; and an elastically deformable exchangeable plate defining a forwardly positioned working pressure receiving surface, said exchangeable plate including an interior space engaged by said coupling continuation of said accommodating carrier from a rear of said exchangeable plate to provide a driving connection, said exchangeable plate being rotatable relative to said accommodating carrier in a first direction to enable said exchangeable plate to be connected to said accommodating carrier and in a second, opposite direction to enable said exchangeable plate to be detached from said accommodating carrier, said coupling continuation having an undercut, spirally shaped edge contour projecting from said forward surface of said accommodating carrier and having an outer edge inclined relative to said forward surface of said accommodating carrier in a direction toward a peripheral edge of said accommodating carrier.

2. A supporting plate according to claim 1, wherein said working pressure receiving surface is a front working surface.

3. A supporting plate according to claim 1, wherein said working pressure receiving surface is an adhering surface for detachably receiving a working medium disk in mounted engagement.

4. A supporting plate according to claim 1, wherein said exchangeable plate is annular.

5. A supporting plate according to claim 1, wherein said exchangeable plate has a thickness not greater than 10 mm and said accommodating carrier includes a flange, said exchangeable plate resting on said flange in an edge region of said exchangeable plate adjoining said interior space.

6. A supporting plate according to claim 1, wherein said exchangeable plate has a thickness which decreases towards an outer peripheral edge of said exchangeable plate.

7. A supporting plate according to claim 3, wherein said adhering surface includes an adhesively engageable surface.

8. A supporting plate according to claim 3, wherein said adhering surface includes a hook fastener facing for adhesion with cooperating loop fasteners.

9. A supporting plate according to claim 1, wherein said exchangeable plate is formed from an elastomeric synthetic resin.

10. A supporting plate according to claim 1, wherein said accommodating carrier includes an injection molded synthetic resin part including an embedded metal element for the driving connection.

11. A supporting plate according to claim 1, wherein said exchangeable plate is formed from an elastomeric synthetic resin; and the working pressure receiving surface includes an annular working surface presenting bristles defined by structural continuations of said exchangeable plate.

12. A supporting plate according to claim 11, wherein the bristles are filled with an abrasive.

13. A supporting plate for rotating tools, comprising:

an accommodating carrier including a flat forward surface, means for forming a driving connection and a coupling continuation arranged on and projecting from said forward surface; and an elastically deformable exchangeable plate defining a forwardly positioned working pressure receiving surface, said exchangeable plate including an interior space engaged by said coupling continuation from a rear of said exchangeable plate and defined by an inner edge, said coupling continuation having an outer edge engaging said inner edge of said exchangeable plate such that a quick-change connection is formed only by the cooperation of said inner edge of said exchangeable plate and said outer edge of said coupling continuation which enables said exchangeable plate to be easily and quickly removed from engagement with said accommodating carrier and easily and quickly connected to said accommodating carrier, said outer edge of said coupling continuation being constructed as a worm seat with an undercut, spirally shaped edge contour, said edge contour of said coupling continuation projecting from said forward surface of said accommodating carrier and having an outer edge inclined relative to said forward surface of said accommodating carrier in a direction toward a peripheral edge of said accommodating carrier.

14. The supporting plate of claim 13, wherein said accommodating carrier is formed from synthetic resin and said means for forming a driving connection comprise a metal element embedded in the synthetic resin.

15. The supporting plate of claim 13, wherein said accommodating carrier includes a flange resting on said exchangeable plate and a handle periphery arranged at a rear of said accommodating carrier such that said flange is situated between said coupling continuation and said handle periphery.

16. The supporting plate of claim 13, wherein said exchangeable plate is annular and said inner edge is spiral shaped.

17. The supporting plate of claim 13, wherein said exchangeable plate is formed from an elastomeric synthetic resin.

18. The supporting plate of claim 13, wherein said exchangeable plate includes bristles forming said working pressure receiving surface.

19. A supporting plate for rotating tools, comprising:

an accommodating carrier including a flat forward surface, means for forming a driving connection and a coupling continuation arranged on and projecting from said forward surface, said coupling continuation having an outer edge;

an elastically deformable exchangeable plate defining a forwardly positioned working pressure receiving surface, said exchangeable plate including an interior space engaged by said coupling continuation from a rear of said exchangeable plate and defined by an inner edge; and coupling means for detachably connecting said exchangeable plate to said accommodating carrier by cooperation of said outer edge of said coupling continuation and said inner edge of said exchangeable plate to enable quick attachment of said exchangeable plate to said accommodating carrier and quick detachment of said exchangeable plate from said accommodating carrier, said coupling means comprising said outer edge of said coupling continuation being a spiral-shaped, undercut edge contour projecting from said forward surface of said accommodating carrier and said inner edge of said exchangeable plate being spiral-shaped.

20. The supporting plate of claim 19, wherein said accommodating carrier is formed from synthetic resin and said means for forming a driving connection comprise a metal element embedded in the synthetic resin.

21. The supporting plate of claim 19, wherein said accommodating carrier includes a flange resting on said exchangeable plate and a handle periphery arranged at a rear of said accommodating carrier such that said flange is situated between said coupling continuation and said handle periphery.

22. The supporting plate of claim 19, wherein said exchangeable plate is formed from an elastomeric synthetic.

23. The supporting plate of claim 19, wherein said exchangeable plate includes bristles forming said working pressure receiving surface.

24. The supporting plate of claim 1, wherein said accommodating carrier includes a flange defining said forward surface, said exchangeable plate being supported on said flange in an edge region of said exchangeable plate adjoining said interior space.

25. The supporting plate of claim 13, wherein said accommodating carrier includes a flange defining said forward surface, said exchangeable plate being supported on said flange in an edge region of said exchangeable plate adjoining said interior space.

26. The supporting plate of claim 19, wherein said accommodating carrier includes a flange defining said forward surface, said exchangeable plate being supported on said flange in an edge region of said exchangeable plate adjoining said interior space.

27. The supporting plate of claim 19, wherein said edge contour has an outer edge inclined relative to said forward surface of said accommodating carrier in a direction toward a peripheral edge of said accommodating carrier.

* * * * *